US011235196B2

(12) United States Patent
Barrow

(10) Patent No.: US 11,235,196 B2
(45) Date of Patent: Feb. 1, 2022

(54) RESISTANCE TRAINING GLOVE

(71) Applicant: Andrew Barrow, New York, NY (US)

(72) Inventor: Andrew Barrow, New York, NY (US)

( * ) Notice: Subject to any disclaimer, the term of this patent is extended or adjusted under 35 U.S.C. 154(b) by 67 days.

(21) Appl. No.: 16/708,471

(22) Filed: Dec. 10, 2019

(65) Prior Publication Data

US 2021/0170220 A1 Jun. 10, 2021

(51) Int. Cl.
*A63B 21/00* (2006.01)
*A63B 71/14* (2006.01)

(52) U.S. Cl.
CPC ..... *A63B 21/4043* (2015.10); *A63B 71/145* (2013.01)

(58) Field of Classification Search
CPC ... A63B 21/4043; A63B 71/145; A63B 21/40; A63B 21/4001; A63B 21/4017; A63B 21/4019; A63B 21/4021; A63B 21/4025; A63B 71/14; A63B 21/065; A63B 31/02
See application file for complete search history.

(56) References Cited

U.S. PATENT DOCUMENTS 1,745,670 A * 2/1930 Gately ..... A63B 71/145 2/18
2,275,206 A * 3/1942 Frederick ..... A63B 71/145 2/18
2,284,300 A * 5/1942 Portal ..... A41D 19/01517 2/160
2,817,088 A * 12/1957 Vrana ..... A63B 71/145 2/18
3,855,633 A * 12/1974 Rhee ..... A63B 71/145 2/18
RE28,480 E * 7/1975 Petrusek ..... A63B 71/145 2/18
3,903,546 A * 9/1975 Rhee ..... A63B 71/145 2/16
4,684,123 A * 8/1987 Fabry ..... A63B 21/065 482/105
4,984,300 A * 1/1991 Cho ..... A63B 71/145 2/16
5,300,000 A * 4/1994 Schwartz ..... A63B 21/0607 482/105
5,458,564 A * 10/1995 Franzen ..... A63B 71/145 2/18
6,202,213 B1 * 3/2001 Georgick ..... A63B 71/145 2/161.1
6,325,747 B1 * 12/2001 Norblom ..... A63B 69/26 482/124

(Continued)

*Primary Examiner* — Andrew S Lo
(74) *Attorney, Agent, or Firm* — McLean Law LLC; Kimberly McLeon, Esq.

(57) ABSTRACT

A resistance training glove device having a glove casing for attachment to an individual's hand. The glove casing includes a first member and a second member. The first and second members are attachably connected to one another to collectively form the glove casing. The first member has a body element which includes an enclosed tank for receiving and storing fluid. The second member includes a handle bar element, a cuff element and a reception cavity. The reception cavity receives the individual's hand when the glove casing is attached to the individual's hand. The stored fluid in the glove casing provides a weighted resistance to the individual during movement of the attached glove casing.

15 Claims, 4 Drawing Sheets

(56) References Cited

U.S. PATENT DOCUMENTS

| | | | | |
|---|---|---|---|---|
| 6,629,911 | B2 * | 10/2003 | Cook | A63B 21/065 482/105 |
| 7,043,763 | B2 * | 5/2006 | Carrillo | A63B 71/081 2/161.1 |
| 9,079,092 | B2 * | 7/2015 | Stack | A63B 71/145 |
| 10,188,893 | B2 * | 1/2019 | Johnson | A63B 21/072 |
| 2002/0128120 | A1 * | 9/2002 | Cook | A63B 21/4023 482/44 |
| 2002/0128126 | A1 * | 9/2002 | Cook | A63B 21/065 482/105 |
| 2002/0148029 | A1 * | 10/2002 | Carlin | A63B 71/14 2/16 |
| 2005/0055752 | A1 * | 3/2005 | Carrillo | A63B 71/145 2/18 |
| 2011/0247124 | A1 * | 10/2011 | Stack | A63B 71/145 2/161.1 |
| 2014/0031180 | A1 * | 1/2014 | Jones | A63B 21/0084 482/111 |
| 2015/0013041 | A1 * | 1/2015 | McBride | A63B 71/145 2/18 |
| 2016/0029719 | A1 * | 2/2016 | Morris | A41D 19/01517 2/160 |
| 2016/0051883 | A1 * | 2/2016 | Clement | A41D 13/08 2/18 |
| 2017/0087438 | A1 * | 3/2017 | Bisaillon | A63B 71/141 |
| 2017/0151487 | A1 * | 6/2017 | Traficante | A63B 71/145 |
| 2018/0235292 | A1 * | 8/2018 | Akinyemi | A41D 19/0027 |

* cited by examiner

RESISTANCE TRAINING GLOVE

FIELD OF THE INVENTION

Embodiments described herein generally relate to resistance training, and more particularly to resistance training gloves.

BACKGROUND OF THE INVENTION

Shadowboxing is a popular exercise for fighters to hone their fighting techniques, condition their muscles, warm-up or warm down during their workouts, or even to mentally prepare themselves before a fight. Shadow boxing, while effective, does not offer any resistance for strength building since there is no opponent involved. This makes maintaining strength and reaching new levels of technique difficult for a fighter to accomplish on their own. Adding resistance to shadow boxing training will help an individual, including a fighter, create power and speed. Hence, there is a need in the art for improved shadow boxing which incorporates resistance training.

BRIEF DESCRIPTION OF THE DRAWINGS

The various advantages of the embodiments of the present disclosure will become apparent to one skilled in the art by reading the following specification and appended claims, and by referencing the following drawings, in which:

SUMMARY OF THE INVENTION

Figure 1:
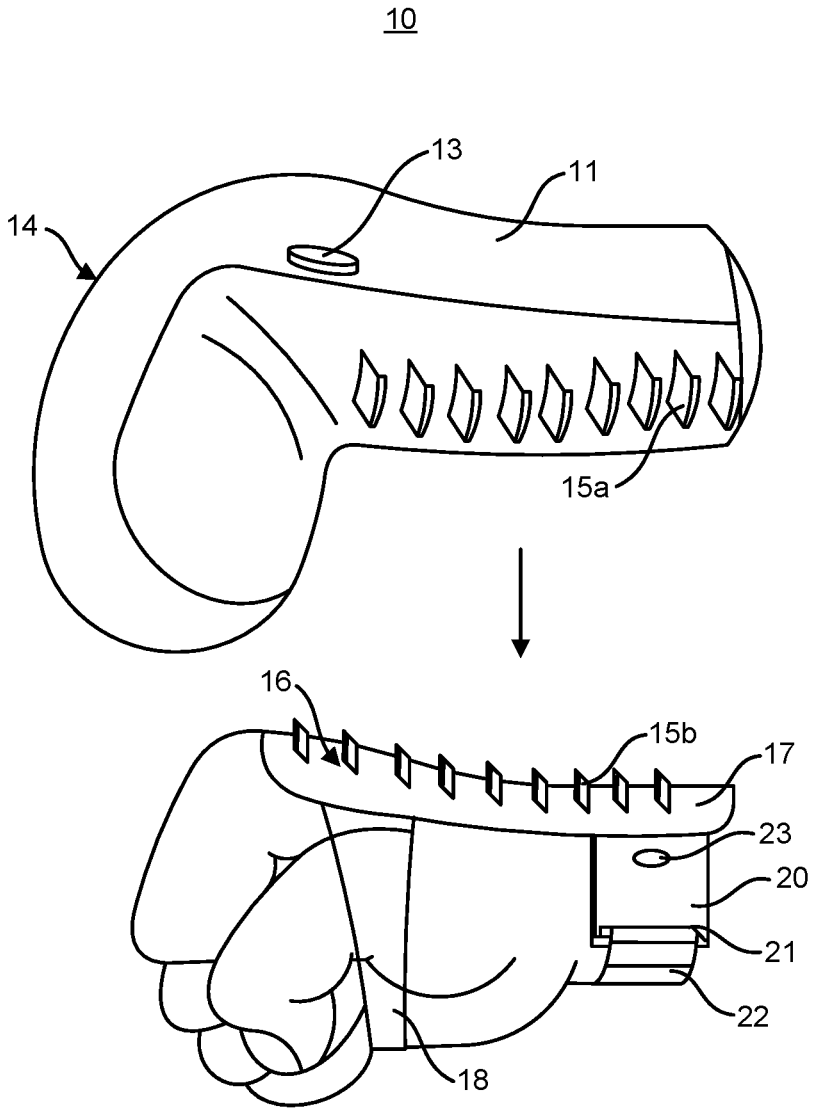
FIG. 1 shows an exemplary exploded view of a resistance training glove device according to an embodiment of the present disclosure.

Exemplary embodiments disclosed herein describe a resistance training glove device having a glove casing for attachment to an individual's hand. The glove casing includes a first member and a second member. The first and second members are attachably connected to one another to collectively form the glove casing. The first member has a body element which includes an enclosed tank for receiving and storing fluid. The second member includes a handle bar element, a cuff element and a reception cavity. The reception cavity receives the individual's hand when the glove casing is attached to the individual's hand. The stored fluid in the glove casing provides a weighted resistance to the individual during movement of the attached glove casing.

In some exemplary embodiments, the reception cavity is formed by a space extending between the handle bar element and the cuff element.

In some exemplary embodiments, the reception cavity formed on an external surface of the glove casing.

In some exemplary embodiments, the first member includes an aperture for receiving the fluid.

In some exemplary embodiments, the first member includes a cap element for closing the aperture so that the received fluid is retained in the enclosed tank.

In some exemplary embodiments, the amount of stored fluid is user-selectable.

In some exemplary embodiments, the first member includes a first set of mating interlocking teeth vertically oriented on a sliding rail.

In some exemplary embodiments, the second member includes a second set of mating interlocking teeth vertically oriented on a sliding rail.

In some exemplary embodiments, the first member and the second member are attachably connected to one another by connecting the first set of mating interlocking teeth with the second set of mating interlocking teeth.

In some exemplary embodiments, the cuff element includes a release button for detaching the first set of mating interlocking teeth and the second set of mating interlocking teeth.

In some exemplary embodiments, the cuff element includes an aperture for receiving an adjustable strap.

In some exemplary embodiments, the cuff element is secured around the individual's wrist with the adjustable strap.

In some exemplary embodiments, the cuff element is shaped like a horseshoe.

In some exemplary embodiments, the individual's first rests on top of a distal end of the handle bar element.

In some exemplary embodiments, the glove casing is shaped similar to a boxing glove.

In some exemplary embodiments, the second member includes a cushioning element.

In some exemplary embodiments, the device includes a pair of glove casings.

DETAILED DESCRIPTION

The present disclosure relates to a resistance training glove device ("the device"). The resistance training glove may be used by an individual for boxing training or exercise in general. The device may be filled with a fluid, such as, for example, water. The water provides a weighted resistance force to the glove which in turn provides a weighted resistance to an individual wearing the device during movement of the device, for example, when used by an individual while performing boxing training or any exercise in general. The fluid filled device allows an individual (i.e., user) to perform resistance training to build power and speed.

Figure 2:
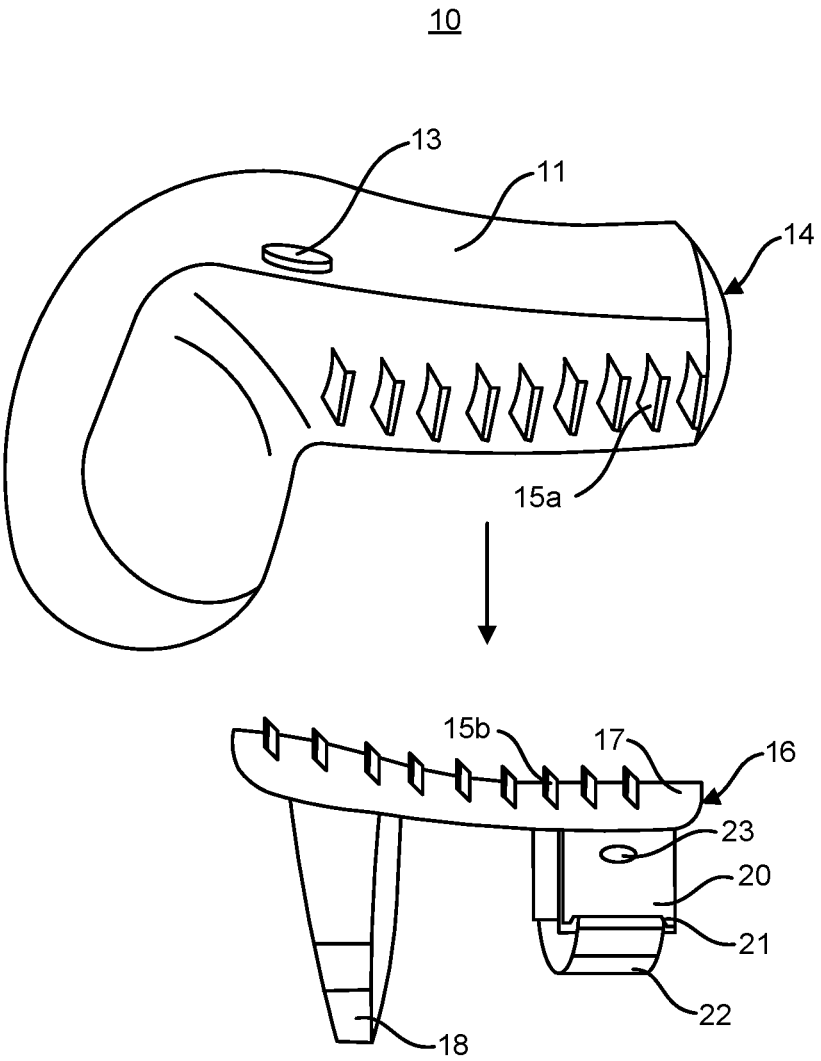
FIG. 2 shows another exemplary exploded view of the resistance training device according to an embodiment of the present disclosure.
Figure 3:
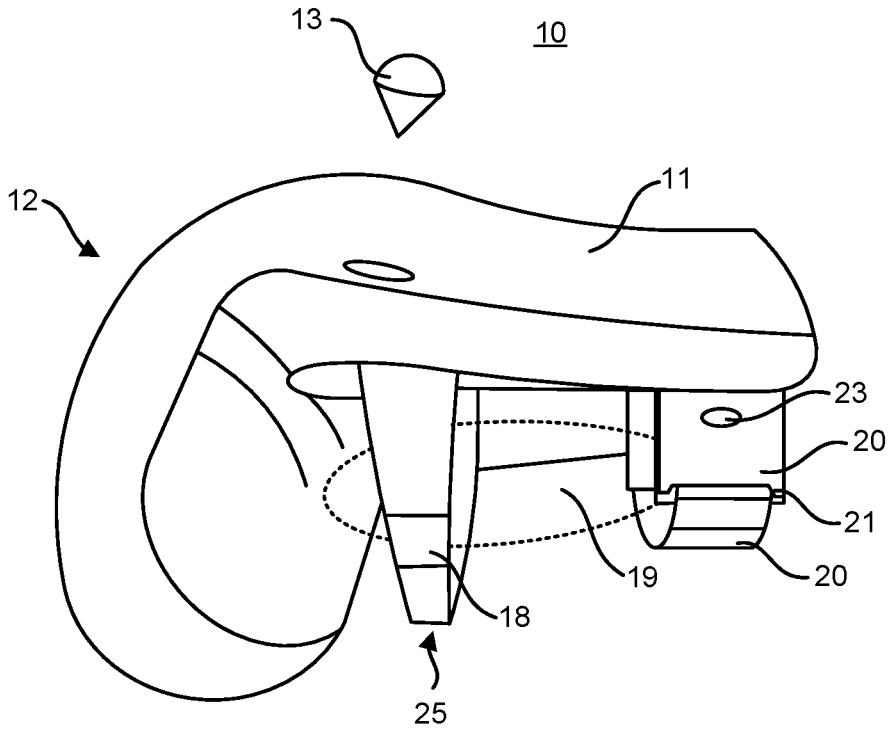
FIG. 3 shows a left elevational exemplary view of the resistance training device according to an embodiment of the present invention
Figure 4:
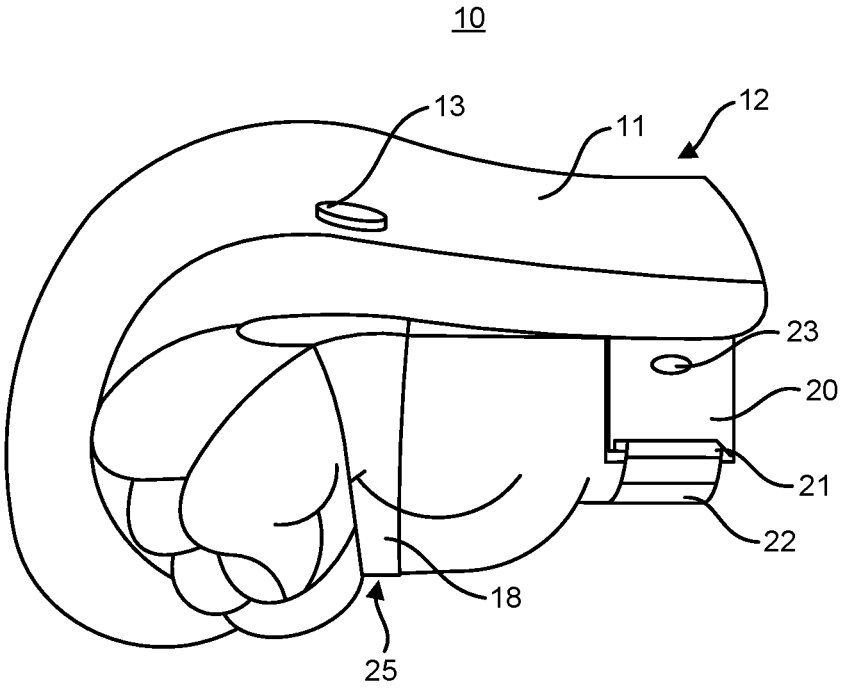
FIG. 4 shows another left elevational exemplary view of the resistance training glove according to an embodiment of the present invention.

As illustrated in FIGS. 1-4, the device 10 includes a glove casing 12, which attaches to an individual's hand. The glove casing may be shaped in any suitable form. In a preferred embodiment, the glove casing is shaped similar to a boxing glove. The glove casing 12 may be made of any suitable rigid and durable material, such as, for example, plastic. The glove casing 12 includes a first member 14 and a second member 16, as shown in FIGS. 1 and 2. The first member 14 and the second member 16 are attachably connected to one another to collectively form the glove casing as shown in FIG. 3. The members are attachably connected by connecting a pair of mating interlocking teeth 15*a* and 15*b* which become securely grasped to one another.

The first member 14 includes a body element having an enclosed tank 11, a cap element 13 and a first set of mating interlocking teeth 15*a*. The enclosed tank 11 may receive fluid and store the received fluid inside the enclosed tank. Any suitable fluid may be used. In a preferred embodiment, the fluid is water. The body of the enclosed tank 11 may be shaped like a boxing glove. The enclosed tank may be configured in any suitable size. Likewise, the enclosed tank may be configured in multiple sizes. The size of the enclosed tank 11 corresponds to the maximum amount of fluid the enclosed tank is able to store, such as, for example, eight ounces, sixteen ounces, twenty-four ounces, thirty-two ounces, etc.

The amount of fluid received (i.e., filled) in the enclosed tank 11 may be user-selectable up to the maximum storage capacity of the enclosed tank 11. As noted, the fluid in the enclosed tank 11 provides a weighted resistance to the glove, and therefore, the amount of fluid in the enclosed tank 11 has a corresponding weight force (i.e., resistance) applied to the glove. So, if a user wants the device 10 to have low resistance, then the user will fill the tank with a small amount of fluid. On the contrary, if the user wants the device to have high resistance, then the user may fill the enclosed tank with a large amount of fluid.

The first member 14 may include an aperture on the external surface of the body member. The aperture allows fluid to enter the enclosed tank 11. The cap element 13 may close the aperture so that the fluid received in the enclosed tank is retained. The cap element 13 may fit inside (e.g., screw into) the aperture to close the aperture. Any suitable cap element configuration may be used. In a preferred embodiment, the cap element 13 is a rubber screw cap. The fluid contained in the enclosed tank 11 may be filled and emptied as desired by the user by removing the cap element to add fluid to the enclosed tank or to drain fluid from the enclosed tank and attaching the cap element to retain fluid added to the enclosed tank.

The first set of mating interlocking teeth 15*a* may be configured to engage with a second set of mating interlocking teeth 15*b* by overlapping one another or by fitting into mutually dependent projections and/or recesses. The first set of interlocking teeth 15*a* may be vertically oriented on a sliding rail located on an external surface of the body element. The interlocking teeth may be made from any suitable material, such as, for example, plastic or metal.

The second member may include a cushioning element 17, handle bar element 18, a cuff element 20, a reception cavity element 19 and a second set of mating interlocking teeth 15*b*. The cushioning element 17 has the second set of mating interlocking teeth 15*b* located on its top surface, which becomes non visible when the first member is attached to the second member. The cushioning element has the handle bar element 18 and the cuff element located on its surface. The handle bar element 18 and the cuff element 20 are both visible when the first member and the second member are attached to one another.

The cushioning element 17 may be formed from a soft material, such as, for example, a foam material. The dorsal side (i.e., back side) of the individual hand's lies adjacent to the rear surface of the cushioning element when the glove casing is attached to the individual's hand. The cushioning element provides comfort to the individual's hand when the glove casing 12 is attached. The handle bar element 18 aids with proper positioning of the glove casing 12 onto an individual's hand when the device 10 is attached to the individual's hand. The handle bar element 18 may be configured in any suitable shape which allows the individual's first to rest on top of a distal end 25 of the handle bar element. The handle bar element 18 may include a rubber grip with one or more finger indentations. The handle bar element may be fixedly attached to the cushioning element 17 and may be formed from any suitable sturdy material, such as, for example, plastic.

The cuff element 20 may include a release button 23 which causes the first set of mating interlocking teeth 15*a* and the second set of mating interlocking teeth 15*b* to detach from one another. When the first and second sets of mating interlocking teeth are detached, the first member and the second member may be detached from one another as shown in FIGS. 1-2. The cuff element 20 may include an aperture 21 for receiving an adjustable strap 22. The cuff element may be secured around the individual's wrist with the adjustable strap to securely attach the glove casing to the individual's hand. The adjustable strap may be adjusted to adequately fit different sized wrists. The adjustable strap may be configured from any suitable mechanism. In a preferred embodiment, the adjustable strap is a Velcro strap. The cuff element 22 may be configured in any suitable shape. In a preferred embodiment, the cuff element 20 is configured to have a horseshoe shape.

The reception cavity 19 may receive the individual's hand when the glove casing 12 is attached to the individual's hand. The reception cavity 19 may be formed by the space extending between the handle bar element and the cuff element on an external surface of the glove casing.

The second set of mating interlocking teeth 15*b* may be vertically oriented on a sliding rail located on a top surface of cushioning element 17. The interlocking teeth may be made from any suitable material, such as, for example, plastic or metal. As noted, the second set of mating interlocking teeth are configured to connect to the first set of mating interlocking teeth.

In another exemplary embodiment, the device may include a pair glove casings. Each glove casing in the pair may be configured as shown in FIGS. 1-4. Moreover, each glove casing may be attached to each hand of an individual respectively.

The language "individual" and "user" have been used interchangeably throughout the disclosure.

The disclosed embodiments are not inclusive and many other modifications and variations will be apparent to someone of ordinary skill in the art with construction skills in the related arts. Together the descriptions and accompanying illustrations seek to provide an explanation of the basic principles of the embodiment and its application. It is therefore intended that the specification and embodiments be considered as exemplary only.

Those skilled in the art will appreciate from the foregoing description that the broad techniques of the embodiments of the present invention may be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

What is claimed is:

1. A resistance training glove device comprising:

a glove casing for attachment to an individual's hand, the glove casing including a first member and a second member, the first and second members are attachably connected to one another to collectively form the glove casing, the first member having a body element including an enclosed tank for receiving and storing fluid and a first set of mating interlocking teeth, the second member including a handle bar element, a cuff element, a second set of mating interlocking teeth and a reception cavity, the reception cavity receives the individual's hand when the glove casing is attached to the individual's hand, and wherein the stored fluid in the glove casing provides a weighted resistance to the individual during movement of the attached glove casing.

2. The device of claim 1, wherein the reception cavity is formed by a space extending between the handle bar element and the cuff element.

3. The device of claim 1, wherein the reception cavity is formed on an external surface of the glove casing.

4. The device of claim 1, wherein the first member includes an aperture for receiving the fluid.

5. The device of claim 4, wherein the first member includes a cap element for closing the aperture so that the received fluid is retained in the enclosed tank.

6. The device of claim 1, wherein an amount of stored fluid is user-selectable.

7. The device of claim 1, wherein the first member and the second member are attachably connected to one another by connecting the first set of mating interlocking teeth with the second set of mating interlocking teeth.

8. The device of claim 7, wherein the cuff element includes a release button for detaching the first set of mating interlocking teeth and the second set of mating interlocking teeth.

9. The device of claim 1, wherein the cuff element includes an aperture for receiving an adjustable strap.

10. The device of claim 9, wherein the adjustable strap is configured to secure the cuff element around the individual's wrist.

11. The device of claim 1, wherein the cuff element is shaped like a horseshoe.

12. The device of claim 1, wherein the individual's fist rests on top of a distal end of the handle bar element.

13. The device of claim 1, wherein the glove casing is shaped similar to a boxing glove.

14. The device of claim 1, wherein the second member includes a cushioning element.

15. The device of claim 1, further comprising a pair of glove casings.

* * * * *